United States Patent [19]

Pearce

[11] Patent Number: 4,511,310

[45] Date of Patent: Apr. 16, 1985

[54] CEILING FAN BLADE ISOLATION

[75] Inventor: Richard A. Pearce, Memphis, Tenn.

[73] Assignee: Robbins & Myers, Inc., Dayton, Ohio

[21] Appl. No.: 585,745

[22] Filed: Mar. 2, 1984

[51] Int. Cl.[3] ..... F04D 29/64

[52] U.S. Cl. ..... 416/134 R; 416/5; 416/204 R

[58] Field of Search ..... 416/93 R, 5, 134 R, 416/204, 205–207, 210, 500

[56] References Cited

U.S. PATENT DOCUMENTS

| | | | |
|---|---|---|---|
| 585,250 | 6/1897 | Bennett | 416/170 C X |
| 1,856,017 | 4/1932 | Baker | 416/170 C X |
| 2,119,398 | 5/1938 | Morse | 416/5 |
| 2,270,583 | 1/1942 | Forton | 416/134 R X |
| 2,299,010 | 10/1942 | Daman | 416/134 R X |
| 2,557,201 | 6/1951 | Punt | 416/134 R X |
| 2,678,104 | 5/1954 | Davis | 416/134 R |
| 4,382,400 | 5/1983 | Stutzman | 416/5 X |
| 4,391,570 | 7/1983 | Stutzman | 416/170 C X |
| 4,396,352 | 8/1983 | Pearce | 416/5 X |
| 4,402,649 | 9/1983 | Laurel | 416/170 C X |

FOREIGN PATENT DOCUMENTS

| | | | |
|---|---|---|---|
| 759535 | 1/1953 | Fed. Rep. of Germany | 416/170 C |
| 333475 | 12/1935 | Italy | 416/204 |
| 203814 | 9/1923 | United Kingdom | 416/134 R |
| 854690 | 11/1960 | United Kingdom | 416/134 R |

*Primary Examiner*—Everette A. Powell, Jr.

*Attorney, Agent, or Firm*—Biebel, French & Nauman

[57] ABSTRACT

An arrangement for isolating engine noises and vibrations or the like from the blades of a ceiling fan include a blade-mounting ring, to which the blade irons are directly attached, and a plurality of elastomeric grommets or bushings carried on the ring. Partially threaded studs extend through the grommets and into the rotor cage to suspend the blade-mounting ring slightly below the rotor cage by the transfer of weight of the blades through the rubber grommets. The blade-iron feet enclose the grommets and prevent the inadvertent withdrawal of the stud members therefrom.

5 Claims, 4 Drawing Figures

CEILING FAN BLADE ISOLATION

BACKGROUND OF THE INVENTION

This invention relates to ceiling fans and more particularly to the isolation of the blades of a ceiling fan from vibrations of the drive motor.

The relatively widespread use of ceiling fans as comfort conditioning and air flow devices has resulted in the use of ceiling fans where motor-induced noises can no longer be tolerated. Paddle blade type ceiling fans are particularly susceptible to the transmission of motor-induced noises since by reason of their large area and length, the blades tend to act as resonating or sound transmitting devices, and thus tend to impart into the air, as noise, vibrations or the like which the blades receive from the drive motor.

The drive motors themselves, while relatively quiet by themselves, nevertheless when used to drive ceiling fan blades can impart objectionable noises to the surrounding atmosphere through the blades. Thus, a noisy stator caused for example by slightly loose stator laminations, which would produce an otherwise relatively unobjectionable and unnoticeable stator hum, may at times be transmitted through the motor structure through the blade-mounting cage or rotor to the blades themselves and produce an objectionably loud noise. Similarly, rotor vibrations or noises and bearing noises may be amplified by the blades and become objectionable.

SUMMARY OF THE PRESENT INVENTION

The present invention is directed to an arrangement by which the paddle type blades of a ceiling fan are elastomerically isolated from vibrations and noises induced by the electric fan motor. To this end, the drive rotor or cage of the ceiling fan is coupled to the blade irons through an elastomeric and vibration isolating coupling arrangement. The coupling arrangement preferably takes the form of a blade-mounting ring, separate from the motor cage, which is driven by the motor cage through elastomeric couplings while being supported out of direct contact with the rotor. In the preferred embodiment, drive members in the form of partially threaded stud bolts are received in at least some of the former blade-iron mounting openings, which members support an annular blade-mounting member or ring through intermediate elastomeric bushings. The interposition of the elastomeric bushings between the blade-mounting ring and the motor drive cage effectively isolates the blades and prevents the unwanted transmission of vibration to the blade elements.

The isolation apparatus of the present invention has the advantage of readily being adapted to existing ceiling fans, for use where a noise problem might have become evident after the fan has become installed. Further, the apparatus is simple for an owner/user to install and yet is effective in supporting and driving the blades of the fan, while providing substantial isolation from motor-induced vibrations.

A blade-mounting ring is employed with threaded openings for receiving the retaining retainer screws of the conventional blade irons. The ring also captures and receives a plurality of elastomeric grommets, with the grommets preferably being positioned in underlying relation to the blade irons so that they are generally out of sight when the same is assembled. The ring itself is secured to the motor drive cage by threaded depending studs, or drive members, in the form of partially threaded fasteners which extend through the grommets and into at least some of the previously provided blade-iron mounting openings in the rotor cage, such that the ring is now suspended exclusively on the grommets, and the grommets are in turn suspended exclusively on the heads of the drive members. The arrangement for isolation is thus compact in that the blades are lowered only slightly from their original plane of rotation. In other words, while rigidly securing each of the blades to a common driving element, in the form of a ring, the ring itself is suspended on elastomeric grommets or bushings in closely spaced but non-contacting relation to the rotor cage.

It is accordingly an object of this invention to provide a ceiling fan with blade vibration isolation.

A further object of the invention is to provide a mounting arrangment for ceiling fan blades by which the blades are elastomerically isolated from the rotor.

A still further object of the invention is the provision of ceiling fan blade isolation which may be retrofitted readily to existing ceiling fans.

A still further object of the invention is to provide a blade-mounting ring, and elastomer grommets for supporting the ring, in which the grommets are in turn supported in depending relation for driving the ring from a rotor cage.

These and other objects and advantages of the invention will be apparent from the following description, the accompanying drawings and the appended claims.

DESCRIPTION OF PREFERRED EMBODIMENT

Figure 1:
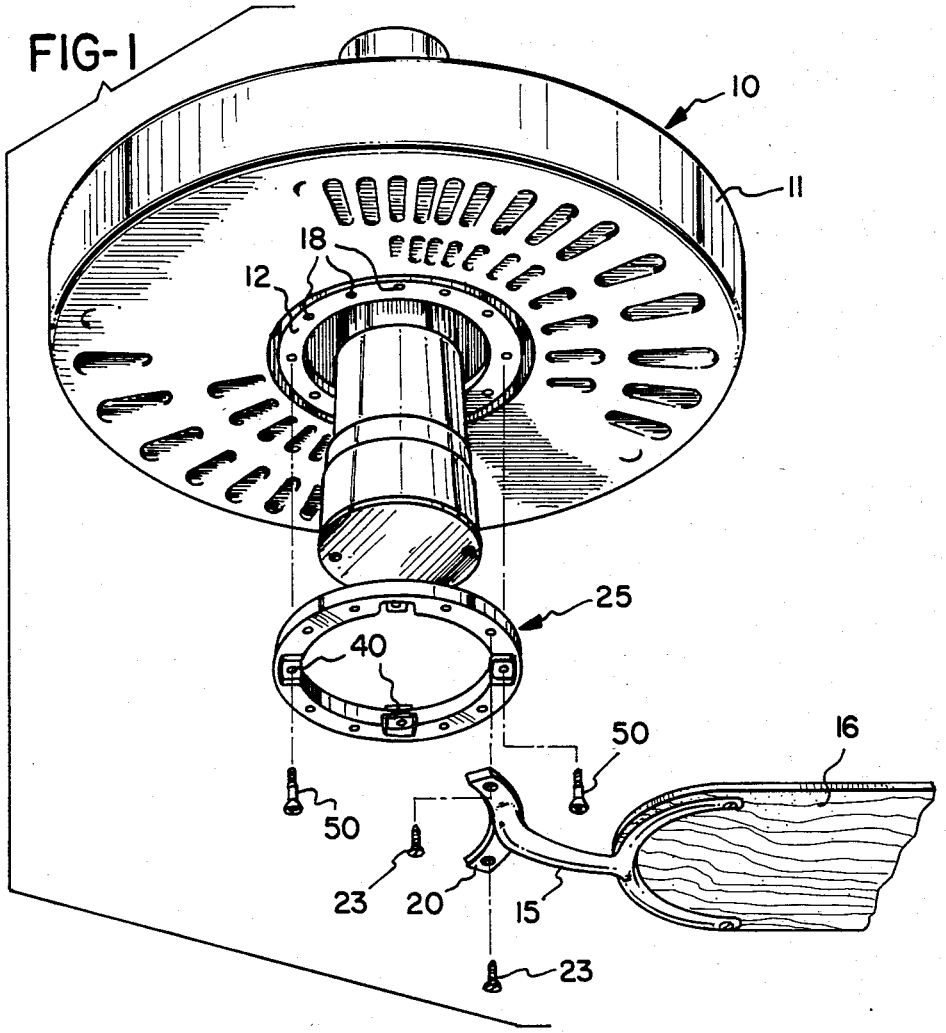
FIG. 1 is a perspective view of a ceiling fan including a blade suspension and isolation arrangement according to this invention.

Referring to the figures of the drawing which illustrate a preferred embodiment of the invention, a ceiling fan to which the invention is applied is illustrated generally at 10 in FIG. 1 as including a motor stator or case 11 and a driven rotor cage 12, which is driven by the motor armature. The rotor cage 12 commonly supports the blade irons of the blades, such as the blade irons 15 which are attached to the blades 16, one of which is shown in FIG. 1. For this purpose, the rotor cage 12 is provided with a plurality of tapped screw receiving openings 18. Generally two of the openings 18 being provided for supporting each of the inner ends of the blade irons. For this purpose, the blade irons 15 are commonly provided with an arcuate blade-mounting base or foot 20. The foot 20 is provided with a flat upper surface and with screw-receiving openings 22 through which blade-mounting screws 23 extend, for supporting the blade irons directly on the rotor cage 12.

In such conventional arrangements, since the blade irons 15 are firmly secured or attached to the rotor cage 12 of the motor armature, by direct metal-to-metal contact, any vibration in the motor field or stator, or in the motor armature, or in the suspension bearings, will tend to be transmitted outwardly of the motor through the irons 15 and to the paddle blades 16 themselves, with the result that the blades may tend to act as radiators in effectively transmitting the vibration of the motor as objectional sound into the a room.

Figure 3:
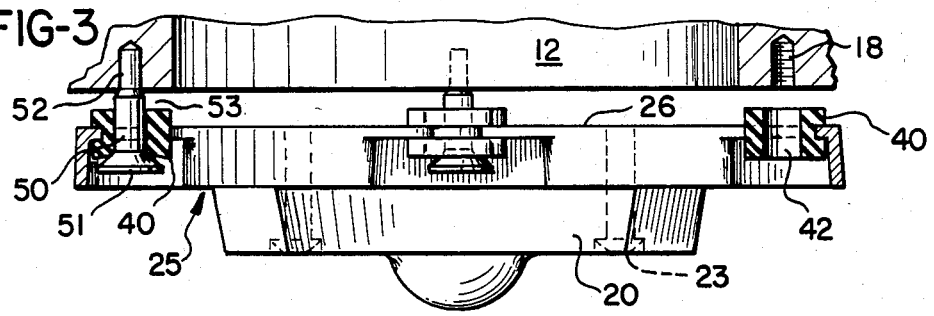
FIG. 3 is a transverse section through the blade-mounting or suspension ring, showing a fragment of the rotor cage, taken generally along the line 3—3 of FIG. 4.
Figure 4:
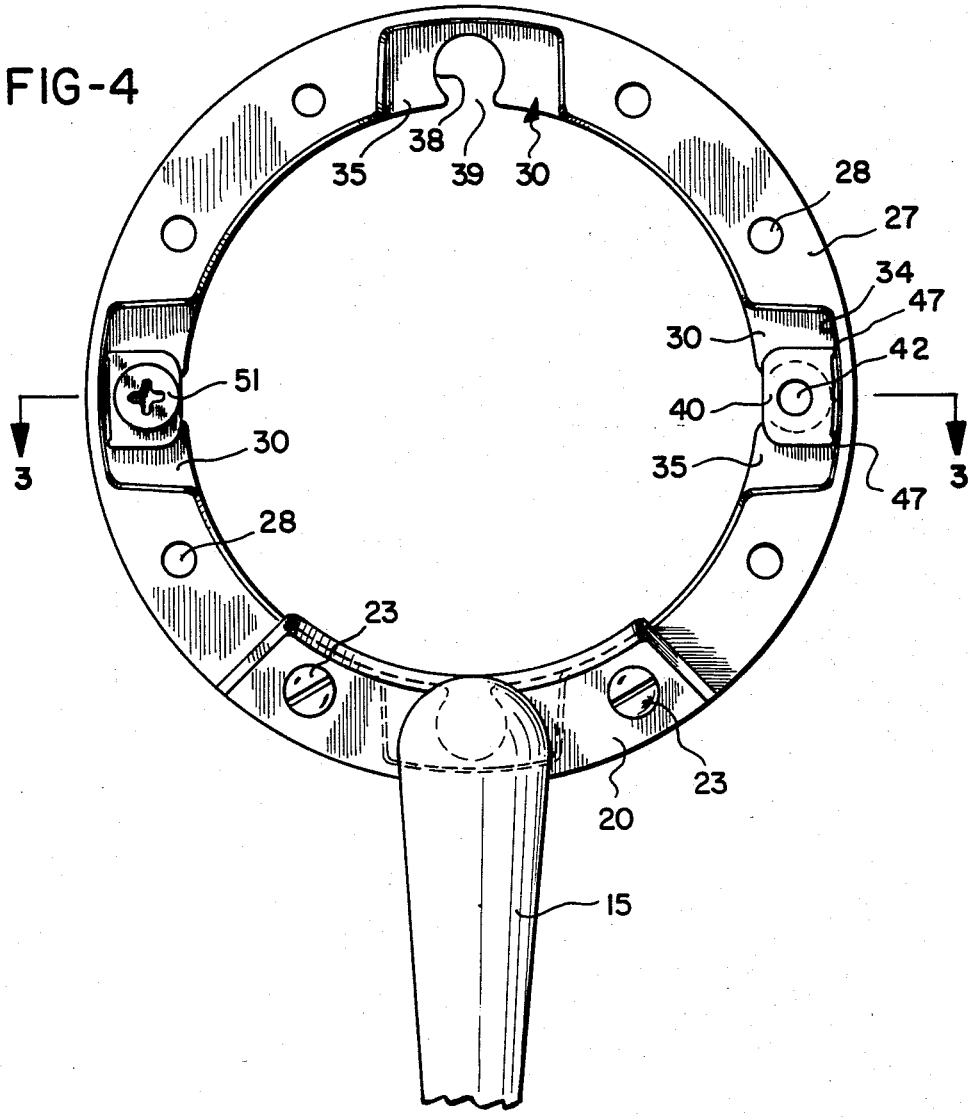
FIG. 4 is an elevational view of the blade-mounting ring with one of the blade irons in place.

Vibration isolation is provided for the blades 16, in this invention, by the provision of a blade suspension and drive member in the form of a blade mount ring 25. The ring 25 has approximately the same diameter as the blade-mounting surface of the cage 12, and provides means by which the blade irons 15 may be directly attached to the ring, and further provides for the support of isolation means for coupling the ring 25 to the cage 12. The blade-mounting ring 25 is best shown in FIGS. 3 and 4, and is provided with a generally planar upper surface 26 and a generally planar lower surface 27. A plurality of tapped openings 28 are formed in the ring, which openings are adapted to receive the threaded fasteners 23, substantially in the same manner as the tapped openings 18 in the cage 12 formerly received these fasteners. The tapped openings 28 provide the means for retaining the mounting feet 20 of the blade irons 15 directly to the lower surface 27.

The lower surface 27 is interrupted with a plurality of arcuately spaced generally inwardly opening recesses 30. The recesses 30 are formed in the ring 25 inwardly from the inner periphery 32, and terminate inwardly of the outer periphery 33 to form an arcuate wall 34 which defines the back surface of the recess 30. Further, the recesses 30 extend from the lower face 27 less than the full thickness of the ring and thus leave a relatively thin section 35 of the ring, which section extends arcuately across the recess. There is further formed in the section 35 a semi-circular inwardly opening aperture or recess 38, which interrupts the inner periphery 32 at a relatively narrow throat 39, as shown in FIG. 4.

Figure 2:
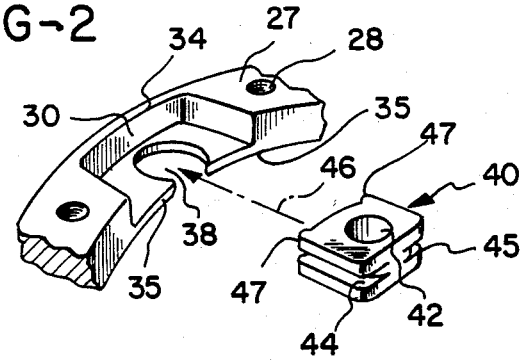
FIG. 2 is a fragmentary exploded view of a portion of the suspension ring showing one of the grommets prior to insertion.

A plurality of elastomeric isolation means, in the form rubber grommets 40, are proportioned to be received substantially within the recesses 30 and particularly supported on the sections 35 within the semi-circular aperture 38. The grommets 40, as shown in FIG. 2, have a generally cubic shape. The grommets 40 are provided with an internal clearance opening 42 which extends axially therethrough, for the purpose of receiving a driving stud or fastener. The side walls of the grommet 40 are provided with opposed outwardly opening grooves 44 and 45, which grooves are proportioned to receive the sections 35 of the ring, at the opening 38, when the grommet is pressed into place and seated in the recess, as illustrated by the arrow 46 in FIG. 2. When the grommet is thus seated, a portion of the grommet extends below the section 35 into the recess 30, but the axial thickness of the grommet 40 is such that the portion which extends into the recesses, is fully contained within the recess. Another portion of the grommet 40 extends above the planar upper surface 26, as best shown in FIG. 3, when the grommet is inserted. The radial outer surface of the grommet 40 is provided with a pair of protuberances 47 which in the seated position of the grommet engage the inside surface wall 34, and support and stabilize the grommet in this position, while the narrow throat or opening 39 tend to retain the grommet in place.

The opening 42 in the grommet is adapted to receive drive means in the form of threaded headed stud members 50. As best seen in FIG. 3, the stud members 50 are only partially threaded at their outer ends at 52. The threads are intended to be received in one of the openings 18 of the rotor cage 12. The stud members 50 extend into the rotor cage only to a predetermined depth defined by the depth of the threads 52, and when the same are inserted through the grommet openings 42, the blade-mounting drive ring 25 is suspended below the cage on the heads 51 of the studs 50. The grommets 40 are not drawn into direct contact with the cage but their upper surface is somewhat spaced from the cage as indicated by the space 53 in FIG. 3.

The grommets 40 provide means together with the stud members 50 for suspending the ring 25 from the rotor cage 12, with the blade irons and blades attached thereto, eliminating metal-to-metal contact. The blade iron feet 20 are secured to the lower surface 27 of the ring 25 in straddling relation to the recesses 30, as shown in FIG. 4. Accordingly, the blade irons effectively cover the recesses and provide an appearance which is not unlike the appearance of the ceiling fan in which the blade irons are attached directly to the rotor cage. Additionally, when the blade irons are in position, they effectively cap and cover the elastomeric fasteners including the threaded stud members 50 and thus tend to prevent inadvertent withdrawal or loss of these members in the event that a stud member becomes loosened in its threaded opening within the cage 12.

The entire weight of the fan blade and blade irons, together with the blade-iron mounting ring, is carried on the stud members 50 through the resilient coupling means defined by the grommets 40, accompanied by a slight deflection of the grommets. Enlarged head 51 is received adjacent the outer surface of the grommet 40, and thus the weight of the ring and blades normally is transmitted to the heads of the stud members, through the grommets. The ring 25 together with the captured grommets 40 is free to slide slightly up an down on the threaded stud members. The purpose of the slight axial freedom of movement is to provide full isolation of the ring 25 from the cage 12, as defined by the space 53 as shown in FIG. 3.

It will accordingly be seen that the invention provides an elastomeric attachment, free of any direct metal-to-metal contact, between the rotor cage 12 of a ceiling fan and the fan blades. Any vibrations in the cage or being transmitted by the cage will tend to be absorbed in the grommets 40, thereby effectively isolating the blades 16 from the effects of such direct transmission of vibration. It has been found that with a four bladed ceiling fan, four recesses 30 and accompanying slots 38, at 90° spacing, one for each blade iron, and four attaching studs have been sufficient. While in such an instance the cage 12 has normally been provided with eight tapped and threaded openings 18 for the blade irons, only four of these openings now come into use. Further the apparatus of the invention lends itself to retrofit to existing ceiling fans, merely by the removal of the fasteners 23 retaining the existing blade irons to the rotor cage, and the insertion of a ring 25 with grommets 40 in place, retained by the partially threaded drive studs or fasteners 50 through the opening within the grommets, so that the ring is in depending relation on the grommets beneath the cage. Thereafter the blade irons may readily be assembled to the ring 25 with the foot portion 20 bridging the recesses 30, to provide an elastomeric drive support which does not substantially alter or change the appearance of the ceiling fan.

While the form of apparatus herein described constitutes a preferred embodiment of this invention, it is to be understood that the invention is not limited to this precise form of apparatus, and that changes may be made therein without departing from the scope of the invention which is defined in the appended claims.

What is claimed is:

1. A ceiling fan having an electric drive motor including a rotor cage, and in which a plurality of paddle-like fan blades are mounted on blade irons for driving by the rotor cage, the improvement comprising:

a plurality of rigid suspension and drive elements depending from said rotor cage, an annular blade-mount member, means on said blade-mount member for mounting said blade irons in arcuately spaced relation to each other, a plurality of elastomeric grommets each having an axial opening therethrough, means mounting said annular blade-mount member to said grommets, and means mounting said grommets to said suspension and drive elements for supporting said blade mount member in spaced relation to said cage, said suspension and drive elements further comprising partially threaded headed studs, one for each said grommet, said studgs received through said grommet openings with the heads thereon on one side of the associated said grommet and supporting said annular blade-mount member and said grommets in depending spaced relation to the rotor cage.

2. An arrangement for isolating motor vibration from transmission through the blade irons and to the blades of a ceiling fan, in which said ceiling fan is provided with an annular rotor cage for driving said blades, comprising:

a blade-mount ring having a diameter, substantially approximately the same as that of said cage, means in said blade-mount ring for attaching blade irons thereto in arcuately spaced relation, means on said blade-mount ring defining a plurality of radially inwardly directed generally U-shaped openings, elastomeric grommets each having means therein defining an outer groove adapted to be received on said ring at each of said openings for supporting said ring on said grommets, means in said grommets defining an axial opening therethrough, and threaded headed stud members extending through said grommet openings and into said rotor cage for drivably supporting said blade-mount ring from said cage exclusively on said grommets, with said ring being spaced axially from said cage in depending and suspended relation on said stud members.

3. The arrangement of claim 2 in which there is one of said U-shaped openings formed in said blade-mount ring for each of said blade irons, and in which said U-shaped openings and the associated said grommet and stud members are positioned on said ring in underlying relation to an associated said blade iron.

4. In a ceiling fan an arrangement for isolating the fan blades from the effects of vibrations of the drive motor, comprising:

a rotor cage having means for supporting a plurality of blade irons thereon, an annular blade-mounting ring having a diameter approximating the diameter of said cage, means on said ring for receiving the inner ends of a plurality of blade irons in angularly spaced relation, fan blades mounted on said blade irons, ring mounting stud bolt members, extending into said cage for supporting said ring in depending spaced relation from the bottom of said cage, and elastomeric grommets having an inner diameter mounting on said bolt members and having means at the outer diameter thereof supporting said ring in depending relation from said mounting bolts, with said grommets in spaced relation to said cage.

5. The ceiling fan arrangement of claim 4 in which said ring includes means defining a plurality of radially inwardly facing openings, and said grommets are provided with means in an outer surface defining inwardly opening grooves, said grommets being proportioned to be received on said ring at said openings with a portion of said ring extending into said grooves, said bolt members extending through the interior of said grommets whereby said grommets transfer the weight of said blade irons and blades to said bolt members accompanied by elastic deflection of said grommets.

* * * * *